US009875686B2

(12) United States Patent
Yin et al.

(10) Patent No.: US 9,875,686 B2
(45) Date of Patent: Jan. 23, 2018

(54) VOLTAGE DRIVING PIXEL CIRCUIT, DISPLAY PANEL AND DRIVING METHOD THEREOF

(71) Applicant: Boe Technology Group Co., Ltd., Beijing (CN)

(72) Inventors: Jingwen Yin, Beijing (CN); Cuili Gai, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 327 days.

(21) Appl. No.: 14/555,911

(22) Filed: Nov. 28, 2014

(65) Prior Publication Data

US 2016/0133188 A1 May 12, 2016

(30) Foreign Application Priority Data

Nov. 12, 2014 (CN) ..... 2014 1 0633624

(51) Int. Cl.
*G09G 3/30* (2006.01)
*G09G 3/3216* (2016.01)

(52) U.S. Cl.
CPC ... *G09G 3/3216* (2013.01); *G09G 2320/0223* (2013.01)

(58) Field of Classification Search
CPC ..... G09G 3/3216; G09G 3/3258; G09G 2300/08; G09G 2320/02; G09G 2320/0223
See application file for complete search history.

(56) References Cited

U.S. PATENT DOCUMENTS 6,115,017 A * 9/2000 Mikami ..... G09G 3/2011 345/92
6,271,816 B1 * 8/2001 Jeong ..... G09G 3/3655 345/87
6,552,709 B1 * 4/2003 Yamaguchi ..... G09G 5/18 345/100
6,791,515 B2 * 9/2004 Kawahaea ..... G09G 3/2022 345/204

(Continued)

FOREIGN PATENT DOCUMENTS

CN 1427388 7/2003
CN 204117565 1/2015

(Continued)

OTHER PUBLICATIONS

Office action from Chinese Application No. 201410633624.7 dated Apr. 22, 2016.

*Primary Examiner* — Amare Mengistu
*Assistant Examiner* — Crystal A Mathews
(74) *Attorney, Agent, or Firm* — Calfee, Halter & Griswold LLP

(57) ABSTRACT

The present disclosure relates to a voltage driving pixel circuit, a display panel and a driving method thereof. The voltage driving pixel circuit comprises: any two power lines and a load connected in each power line, wherein there is one or more switching circuits between the any two power lines. By means of the voltage driving pixel circuit of the present disclosure, the power lines form a network structure in the light emitting phase, so as to avoid voltage change of the power line voltage Vdd of each row in the pixel in the light emitting phase, thereby improving lateral resistance drop and crosstalk phenomenon of the variable power line voltage Vdd.

19 Claims, 2 Drawing Sheets

(56) References Cited

U.S. PATENT DOCUMENTS

| | | | | |
|---|---|---|---|---|
| 2004/0032278 | A1* | 2/2004 | Orii | G02F 1/136259 324/760.02 |
| 2004/0104908 | A1* | 6/2004 | Toyozawa | G09G 3/3648 345/211 |
| 2004/0263085 | A1 | 12/2004 | Chen et al. | |
| 2005/0156861 | A1* | 7/2005 | Song | G09G 3/3677 345/100 |
| 2005/0189538 | A1 | 9/2005 | Choi et al. | |
| 2006/0071823 | A1* | 4/2006 | Jungwirth | G09G 3/2018 341/50 |
| 2006/0145974 | A1* | 7/2006 | Willis | G09G 3/20 345/84 |
| 2007/0120778 | A1* | 5/2007 | Kimura | G09G 3/3216 345/76 |
| 2007/0252160 | A1* | 11/2007 | Kim | G09G 3/3216 257/88 |
| 2008/0150860 | A1* | 6/2008 | Hong | G09G 3/3677 345/87 |
| 2009/0146711 | A1* | 6/2009 | Senda | G09G 3/2096 327/158 |
| 2009/0302898 | A1* | 12/2009 | Sato | B41J 2/45 327/111 |
| 2010/0265234 | A1* | 10/2010 | Fukuo | G09G 3/3614 345/211 |

FOREIGN PATENT DOCUMENTS

| | | |
|---|---|---|
| JP | 2008233400 | 10/2008 |
| JP | 2009116148 | 5/2009 |

* cited by examiner

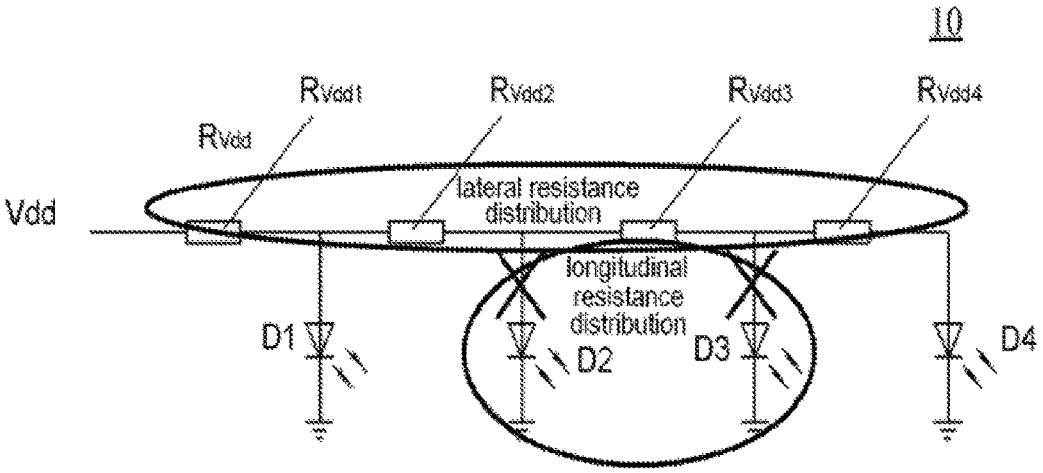
Fig. 1 -Prior Art-
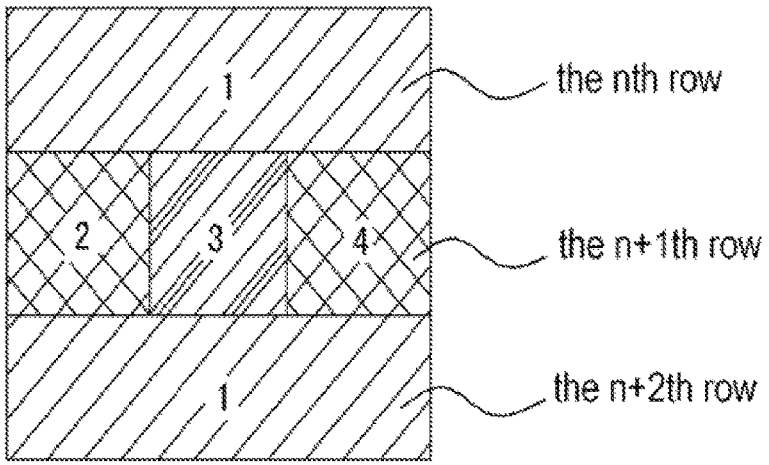
Fig. 2 -Prior Art-

VOLTAGE DRIVING PIXEL CIRCUIT, DISPLAY PANEL AND DRIVING METHOD THEREOF

RELATED APPLICATION

This disclosure claims the benefit of Chinese patent application of No. 201410633624.7 filed in the SIPO on Nov. 12, 2014, Chinese patent application of No. 201410633624.7 is incorporated herein by reference in its entirety.

FIELD OF THE DISCLOSURE

The present disclosure relates to a voltage driving pixel circuit, a display panel comprising the voltage driving pixel circuit as well as a driving method of the voltage driving pixel circuit.

BACKGROUND OF THE DISCLOSURE

In recent years, the organic light emitting diode (OLED) has become a very popular new flat panel display product at home and abroad, because the OLED display has the characteristics of self-luminous, wide viewing angle, short reaction time, high luminous efficiency, wide color gamut, low working voltage, thin panel, capable of fabricating large size and flexible panel as well as simple fabrication process etc., moreover, it also has the potential of low cost.

In large size display applications e.g. OLED, since there is certain resistance in the backplane power line, and the drive currents of all pixels are provided by the power line voltage Vdd on the power line, the supply voltage of the area in the backplane that is close to the power supply location of the power line voltage Vdd is higher than the supply voltage of the area that is relatively far from the power supply location, such a phenomenon is called resistance drop (IR Drop). Since the power line voltage Vdd is associated with the current, the resistance drop will result in current difference in different areas, thereby generating the Mura phenomenon in display. The Mura phenomenon is well known in the art, it actually refers to human eye perceived difference in current and luminance of e.g. an OLED display. For example, as for an active matrix organic light emitting diode (AMOLED) device separately driven by the power line voltage Vdd of each row with a compensating circuit, FIG. 1 schematically shows the arrangement of lateral resistance distribution, longitudinal resistance distribution and light emitting diodes in pixels of the prior art. As shown in FIG. 1, the load $R_{Vdd}$ in a line where the power line voltage Vdd locates e.g. comprises four loads, which are collectively referred to as the lateral resistance distribution, the loads each are represented by $R_{Vdd1}$, $R_{Vdd2}$, $R_{Vdd3}$, $R_{Vdd4}$ respectively.

The second line shows four light emitting diodes D1, D2, D3, D4. The arrangement in the third line is same as that in the first line, which is not shown. The four loads $R_{Vdd1}$, $R_{Vdd2}$, $R_{Vdd3}$, $R_{Vdd4}$ are all supplied with power by the power line voltage Vdd of the power line. In a particular case, the light emitting diodes D2, D3 do not need to emit light, the light emitting diodes D1, D4 emit light. Since each of the four loads $R_{Vdd1}$, $R_{Vdd2}$, $R_{Vdd3}$, $R_{Vdd4}$ generates a certain voltage drop, the distances of the light emitting diodes D1, D4 relative to the power line voltage Vdd are different, thus the voltages and currents provided to the light emitting diodes D1, D4 have been different, thereby even in the event that the light emitting diodes D1, D4 emit the same color, the light emitting diodes D1, D4 are different in luminance, i.e., the grey level is different, thereby the Mura phenomenon is generated. FIG. 2 schematically shows Mura generated by the pixels of the prior art according to FIG. 1 in the case of emitting light. Specifically, as shown in FIG. 2, there is no dark areas in the upper and lower two rows, i.e., the nth row and the n+2th row, the pixels in the two rows are in full bright, the areas 1 in the nth row and the n+2th row are both in full bright. The area 2 in the n+1th row is close to the power line voltage Vdd (IC binding area), the area 3 in the n+1th row is a dark area, there is no longitudinal resistance distribution, i.e., the light emitting diodes D2, D3 do not need to emit light, the light emitting diodes D1, D4 emit light, the longitudinal resistance distribution exists. Due to the presence of the four loads $R_{Vdd1}$, $R_{Vdd2}$, $R_{Vdd3}$, $R_{Vdd4}$, the luminance becomes dark gradually from the area 2 that is close to the power line voltage Vdd to the area 4 at a location relatively far from the power line voltage Vdd, i.e., the area 4 is darker then the area 2. The effect perceived by the human eyes is that the area 2 is much brighter than the area 1, the area 4 is a little brighter than the area 1, the area 3 is a dark area.

Therefore, it is urgently required in the prior art to improve the Mura phenomenon caused by resistance drop and the resulting crosstalk in image display.

SUMMARY OF THE DISCLOSURE

In view of this, the present disclosure provides a voltage driving pixel circuit, a display panel comprising the voltage driving pixel circuit and a driving method of the voltage driving pixel circuit, which can resolve or at least mitigate at least part of the defects in the prior art.

According to a first aspect of the present disclosure, a voltage driving pixel circuit is provided, which may comprise: any two power lines and a load connected in each of the power lines, wherein there is one or more switching circuits between the any two power lines.

By means of the voltage driving pixel circuit of the present disclosure, two or more separately controlled thin film transistors are added in the pixels to form a switching circuit, and the routes of two adjacent power line voltages Vdd are connected, such that a network power line voltage of Vdd structure is formed in the light emitting phase, so as to avoid voltage change of the power line voltage Vdd of each row in the light emitting phase, thereby improving lateral resistance drop and crosstalk phenomenon of the variable power line voltage Vdd.

In an embodiment of the present disclosure, there is one or more switching circuits between all any two power lines.

In another embodiment of the present disclosure, the any two power lines are power lines in odd rows.

In a further embodiment of the present disclosure, the any two power lines are power lines in even rows.

In yet another embodiment of the present disclosure, the any two power lines are adjacent.

In a further embodiment of the present disclosure, the farther from the input side of the power line, the more the switching circuits are arranged.

In an embodiment of the present disclosure, each switching circuit is turned on only in a period of time when the any two power lines are both of high voltage.

In another embodiment of the present disclosure, each of the switching circuits comprises two thin film transistors.

In yet another embodiment of the present disclosure, the nth power line in the any two power lines is connected to drains of a first thin film transistor and a second thin film transistor, the n+1th power line in the any two power lines is connected to the gate of the first thin film transistor and the source of the second thin film transistor, the source of the first thin film transistor is connected to the gate of the second thin film transistor.

In a further embodiment of the present disclosure, each of the switching circuits comprises more than three thin film transistors.

According to a second aspect of the present disclosure, a display panel is provided, comprising a voltage driving pixel circuit as stated above.

According to a third aspect of the present disclosure, a method for driving the above voltage driving pixel circuit is provided, wherein each switching circuit is turned on only in a period of time when the any two power lines are both of high voltage.

By means of the display panel and the method of driving the above voltage driving pixel circuit of the present disclosure, the voltage change of the power line voltage Vdd of each row in the light emitting phase is avoided, thereby improving lateral resistance drop and crosstalk phenomenon of the variable power line voltage Vdd.

BRIEF DESCRIPTION OF DRAWINGS

By explaining in detail the embodiments in conjunction with the drawings, the above and other features of this disclosure will be more obvious, wherein:

FIG. 1 schematically shows the arrangement of lateral resistance distribution, longitudinal resistance distribution and light emitting diodes in pixels of the prior art.

FIG. 2 schematically shows Mura generated by the pixels of the prior art according to FIG. 1 in the case of emitting light.

DETAILED DESCRIPTION OF THE DISCLOSURE

Figure 3:
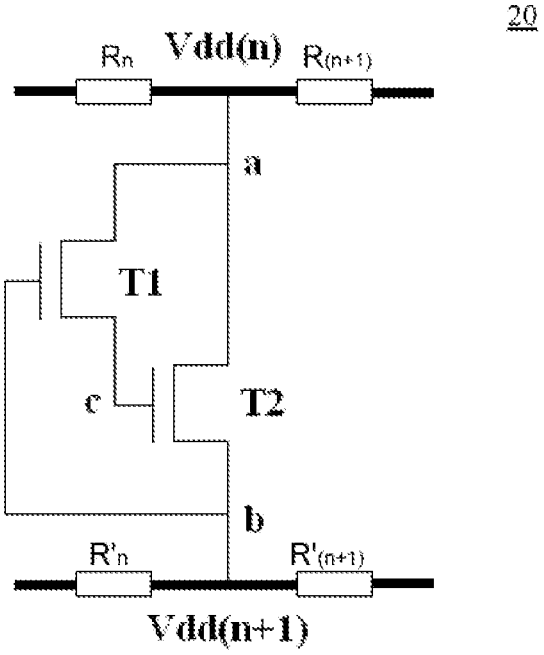
FIG. 3 schematically shows a voltage driving pixel circuit in a pixel according to an embodiment of the present disclosure.

It should be indicated firstly that the terms such as "up", "down", "left", "right", etc., regarding positions and directions mentioned in the present disclosure are directions viewed from the paper face of the drawings. Therefore, the terms such as "up", "low", "left", "right", etc., regarding positions and directions in the present disclosure only represent relative position relationships as shown in the drawings, this is only given for the purpose of explanations, not intended to limit the scope of this disclosure.

Next, the present disclosure will be described in detail with reference to FIGS. 1-4.

It has been described in detail in the BACKGROUND OF THE DISCLOSURE that due to the resistance drop generated by the lateral resistance distribution in two adjacent power lines in the prior art as shown in FIG. 1 and FIG. 2, the Mura as shown in area 3 is generated.

FIG. 3 schematically shows a voltage driving pixel circuit 20 in a pixel according to an embodiment of the present disclosure, which may comprise: any two power lines and a load connected in each of the power lines, wherein there is one or more switching circuits between the any two power lines. For example, the voltage driving pixel circuit 20 may comprise a first power line and a first load connected in the first power line, a second power line and a second load connected in the second power line . . . a nth power line and a nth load connected in the nth power line, a n+1th power line and a n+1th load connected in the n+1th power line . . . , wherein there is an AND circuit between any two adjacent power lines. The voltage driving pixel circuit 20 in FIG. 3 shows a nth power line Vdd (n) therein and a nth load connected in the nth power line. It shall be pointed out that the loads mentioned in respective embodiments of the present disclosure, or a first load, a second load . . . a nth load, a n+1th load and so on mentioned specifically do not signify that these loads only represent one load, instead, they can represent a series of loads. Such expressions are used only for distinguishing the loads in the first power line, the second power line . . . the nth power line, the n+1th power line, and have no restrictive meanings. For example, the first load in the first power line may comprise a plurality of loads, the second load in the second power line . . . , the nth load in the nth power line, the n+1th load in the n+1th power line may all comprise a plurality of loads. As for the number and variety of the load in each power line, it can be determined based on different conditions, this is not difficult for the skilled person in the art to understand. It is not the inventive point of the present disclosure, therefore no more details will be given.

FIG. 3 schematically shows load Rn and load Rn+1 in the nth power line, and load R'n and load R'n+1 in the n+1th power line. As mentioned above, the load Rn, the load Rn+1, the load R'n, and the load R'n+1 as shown here are only schematic, and do not signify that the nth power line only comprises load Rn and load Rn+1, nor signify that the n+1th power line only comprises load R'n and load R'n+1. FIG. 3 shows that there is a switching circuit between any two adjacent power lines. For example, there is a switching circuit between the nth power line and the n+1th power line, wherein the power line voltage of the nth power line or called power supply voltage is Vdd(n), the power line voltage of the n+1th power line or called power supply voltage is Vdd(n+1). In other variant embodiments of the present disclosure, the any two power lines may be adjacent, e.g., as shown in FIG. 3. The any two power lines may also be power lines in odd rows, it should be noted that the power lines in odd rows may be power lines in adjacent odd rows and may also be power lines in non adjacent odd rows, considering the influence of the transmission distance between the voltages of the power supply as well as the cost influence, here the power lines in adjacent odd rows are taken as the example, e.g., switching circuits are arranged between the first row and the third row, or between the third row and the fifth row, or the fifth row and the seventh row . . . . Preferably, the switching circuits are arranged between power lines of all adjacent odd rows, in this way, it will be more favorable for the power line voltage Vdd of each row to be approximate as far as possible, so as to avoid voltage change of the power line voltage Vdd of each row in the light emitting phase, thereby improving lateral resistance drop and crosstalk phenomenon of the variable power line voltage Vdd.

Alternatively, the any two power lines are power lines in even rows, it should be noted that the power lines in even rows may be power lines in adjacent even rows and may also be power lines in non adjacent even rows, considering the influence of the transmission distance between the voltages of the power supply as well as the cost influence, here the power lines in adjacent even rows are taken as the example, e.g., switching circuits are arranged between the second row and the fourth row, or between the fourth row and the sixth row, or the sixth row and the eighth row . . . . Preferably, The switching circuits are arranged between power lines of all adjacent even rows, in this way, it will be more favorable for the power line voltage Vdd of each row to be approximate as far as possible, so as to avoid voltage change of the power line voltage Vdd of each row in the light emitting phase, thereby improving lateral resistance drop and crosstalk phenomenon of the variable power line voltage Vdd.

Alternatively, the switching circuits are arranged between all any two power lines, considering from the cost, it is more preferable that the switching circuits are arranged between all adjacent power lines, i.e., the switching circuits are arranged between the first row and the second row, between the second row and the third row, between the third row and the fourth row . . . , in this way, it will be more favorable for the power line voltage Vdd of each row to be approximate as far as possible, so as to avoid voltage change of the power line voltage Vdd of each row in the light emitting phase, thereby improving lateral resistance drop and crosstalk phenomenon of the variable power line voltage Vdd.

It should be further pointed out that for each power line, each load in the power line will generate a certain voltage drop, this is inevitable. The farther from the input side of the power line, the more the voltage drop will be generated. For example, if the power line voltage Vdd(n) in the nth power line in FIG. 3 is inputted from the left side in the figure (not shown), a certain voltage drop will be generated on both the load Rn and the load Rn+1. Here, the farther from the input side of the power line, the lower the voltage will be. For example, the left side voltage of the load Rn is higher than the right side voltage of the load Rn (i.e., the left side voltage of the load Rn+1), while the left side voltage of the load Rn+1 is higher than the right side voltage of the load Rn+1, in such a case, with more and more loads are arranged, the voltage will be lower and lower, in this way, the lateral resistance drop and the crosstalk phenomenon along the variable power line voltage Vdd will be very serious. In order to avoid such a case, the farther from the input side of the power line, the more the switching circuits are arranged. That is, for the switching circuits arranged between any two power lines, the farther from the input side of the power line, the more the switching circuits are arranged, this is not difficult for the skilled person in the art to understand.

In an embodiment of the present disclosure, each switching circuit may comprise two thin film transistors, e.g., the thin film transistors T1 and T2 shown in FIG. 3. The two thin film transistors T1 and T2 may be thin film transistors of any type, such as coplanar type, inverted coplanar type, staggered type, inverted staggered type, bottom gate type or top gate type etc., this can be understood by the skilled person in the art.

The switching circuit shown in FIG. 3 only schematically shows that there is a switching circuit between the nth power line and the n+1th power line. In order to avoid occurrence of voltage change of the power line voltage in the row where each power line locates during the light emitting phase, preferably, there is a switching circuit between any two adjacent power lines. For example, there are switching circuits between the first power line and the second power line, between the second power line and the third power line, between the third power line and the fourth power line . . . between the nth power line and the n+1th power line, as mentioned above. The structure of each switching circuit may be same, for example, each adopts the structure as shown in FIG. 3. The structure of each switching circuit may also be different, for example, the switching circuit structure consisting of three or more thin film transistors is adopted. Although the switching circuit structure consisting of three or more thin film transistors is not shown in the drawings of the present disclosure, it is not difficult to be achieved by the skilled person in the art based on the teaching of the present disclosure and the knowledge of the prior art.

In the voltage driving pixel circuit 20 as shown in FIG. 3, wherein for example the nth power line in any two power lines is connected to the drains of the first thin film transistor T1 and the second thin film transistors T2, for example, the drains of the first thin film transistor T1 and the second thin film transistors T2 are connected between the load Rn and the load R(n+1) in the nth power line through a common node a. For example the n+1th power line in any two power lines is connected to the sources of the first thin film transistor T1 and the second thin film transistors T2, for example, the gate of the first thin film transistor T1 and the source of the second thin film transistor T2 are connected between the load R'n and the load R'(n+1) in the n+1th power line through a common node b. The source of the first thin film transistor T1 is connected to the gate of the second thin film transistor T2. For example, the source of the first thin film transistor T1 is connected to the gate of the second thin film transistor T2 via a node c. The switching circuit located between the nth power line and the n+1th power line as shown in FIG. 3 is not schematic, the switching circuits between the first power line and the second power line, between the second power line and the third power line, between the third power line and the fourth power line . . . between the nth power line and the n+1th power line may be connected in the similar way. For example. the switching circuit structure consisting of three or more thin film transistors may be adopted.

Figure 4:
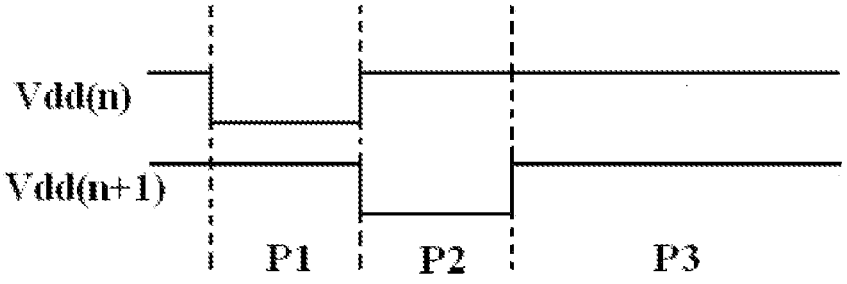
FIG. 4 schematically shows a diagram of a relationship between voltage and time of two power lines in the voltage driving pixel circuit as shown in FIG. 3.

FIG. 4 schematically shows a diagram of a relationship between voltage and time of two power lines in the voltage driving pixel circuit as shown in FIG. 3. In the diagram of the relationship between the voltage and time as shown in FIG. 4, three phases P1, P2 and P3 are shown schematically.

During phase P1, the power line voltage Vdd(n) in the nth power line is a low voltage, i.e., the node a is a low voltage. Here, the power line voltage Vdd(n+1) in the n+1th power line is a high voltage, i.e., the node b is a high voltage. In phase P1, the gate of the thin film transistor T1 is a high voltage, hence, the thin film transistor T1 is turned on. Since the node c connected by the gate of the thin film transistor T2 is in a low voltage state close to the node a, the thin film transistor T2 is in a cut-off state, and is not turned on. In this way, the switching circuit between the nth power line and the n+1th power line is not turned on, the corresponding power line voltage Vdd(n) and the power line voltage Vdd(n+1) are not interconnected. During phase P1, since the power line voltage Vdd(n) in the nth power line is a low voltage, the compensation action is completed. Such a compensation action includes discharging or signal writing etc., in the low voltage phase. It is known by the skilled person in the art that in the display process of e.g. the OLED display, these low voltage phases for discharging or signal writing etc., are absolutely necessary.

During phase P2, in the display technology in the art, for example, in an OLED, it is generally displayed row by row, after display of the pixel units in the nth power line are finished, the image will proceed to the n+1th power line, i.e., in phase P2, the power line voltage Vdd(n+1) in the n+1th power line is in a low voltage state, while the power line voltage Vdd(n) in the nth power line is a high voltage. During phase P2, the power line voltage Vdd(n) in the nth power line is a high voltage, i.e., the node a is a high voltage. Here, the power line voltage Vdd(n+1) in the n+1th power line is a low voltage, i.e., the node b is a low voltage. In phase P2, the gate of the thin film transistor T1 is a low voltage, hence, the thin film transistor T1 is cut off. Since the node c connected by the gate of the thin film transistor T2 continues to keep the previous low voltage state, the thin film transistor T2 is in a cut-off state. In this way, the switching circuit between the nth power line and the n+1th power line is not turned on, the corresponding power line voltage Vdd(n) and the power line voltage Vdd(n+1) are not interconnected. During phase P2, since the power line voltage Vdd(n+1) in the n+1th power line is a low voltage, the compensation action is completed. Such a compensation action includes discharging or signal writing etc., in the low voltage phase. It is known by the skilled person in the art that in the display process of e.g. the OLED display, these low voltage phases for discharging or signal writing etc., are absolutely necessary.

During phase P3, with the progress of row by row display, after the display of the pixel units in the n+1th power line is finished, the image will proceed to the n+2th power line, i.e., in phase P3, the power line voltage Vdd(n+2) in the n+2th power line is in a low voltage state, while the power line voltage Vdd(n) in the nth power line, the power line voltage Vdd(n+1) in the n+1th power line are both high voltages. It is not shown in FIG. 4 the n+2th power line and the corresponding power line voltage. However, it is not difficult for the skilled person in the art to understand based on the above introduction. During phase P3, the power line voltage Vdd(n) in the nth power line is a high voltage, i.e., the node a is a high voltage. Here, the power line voltage Vdd(n+1) in the n+1th power line is also a high voltage, i.e., the node b is a high voltage. In phase P3, the gate of the thin film transistor T1 is a high voltage, hence, the thin film transistor T1 is turned on. Since the node c connected by the gate of the thin film transistor T2 is in a high voltage state close to the node a, the thin film transistor T2 is also in the turn-on state. In this way, the switching circuit between the nth power line and the n+1th power line is turned on, the corresponding power line voltage Vdd(n) and the power line voltage Vdd(n+1) are interconnected. Thus, in phase P3, interconnection between the power line voltage Vdd(n) and the power line voltage Vdd(n+1) in the light emitting phase comes true. Alternatively, since interconnection among the power line voltage Vdd(1) in the first power line, the power line voltage Vdd(2) in the second power line, the power line voltage Vdd(3) in the third power line . . . the power line voltage Vdd(n) in the nth power line, the power line voltage Vdd(n+1) in the n+1th power line . . . can come true in phase P3, such that respective power line voltages form a network power line voltage Vdd structure during the light emitting phase e.g. phase P3. The purpose of the present disclosure neither lies in how to eliminate the low voltage phase in the power line voltage Vdd or the power line voltage Vdd(n+1), nor lies in how to eliminate existence of phase P1 and phase P2, instead, it lies in how to avoid in the phase P3 change of the power line voltage Vdd in each row during the light emitting phase, thereby enabling the power line voltage Vdd in each row to be approximate as far as possible, i.e., enabling the power line voltage Vdd(1) in the first power line, the power line voltage Vdd(2) in the second power line, the power line voltage Vdd(3) in the third power line . . . the power line voltage Vdd(n) in the nth power line, the power line voltage Vdd(n+1) in the n+1th power line . . . to be approximate as far as possible. Thereby, the lateral resistance drop of the variable power supply and the crosstalk between the images are improved, hence, the generation of Mura in image display is avoided.

From the analysis of the above three phases P1, P2 and P3 it can be seen that each of the switching circuits is only turned on in a period of time when the two power lines are both of high voltage, in the event that the power line voltage Vdd of any one power line is a low voltage, no switching circuit connected with the any one power line is turned on.

In another embodiment of the present disclosure, each of the switching circuits may comprise more than three thin film transistors. Although such a case is not shown in the drawings of the present disclosure, it is not difficult for the skilled person in the art to understand based on the above teaching of the present disclosure. It should be pointed out that with the increase of the integration level of the integrated circuit, there are more and more integrated elements on an integrated circuit of a unit area. Preferably, a switching circuit consisting of two thin film transistors is provided between two adjacent power lines, thus a relatively small area of the integrated circuit is occupied, moreover, fewer transistors are used, and the fabrication cost can also be reduced.

It should be pointed out that although FIG. 3 and FIG. 4 are described with two adjacent power lines and a switching circuit connected between them, the embodiments of the present disclosure are not limited to the case of adjacent power lines. Just as mentioned above, the switching circuit can be arranged between any two power lines, for example, the switching circuit can be arranged between adjacent power lines, between power lines in odd rows, between power lines in even rows, this is not difficult for the skilled person in the art to understand.

According to a second aspect of the present disclosure, a display panel is provided, which may comprise a voltage driving pixel circuit as stated above.

According to a third aspect of the present disclosure, a method for driving the above voltage driving pixel circuit is provided, wherein each of the switching circuits is turned on only in a period of time when the any two power lines are both of high voltage. In the event that the power line voltage of any one power line is a low voltage, no switching circuit connected with the any one power line is turned on.

Although the present disclosure has been described with reference to the currently considered embodiments, it should be understood that the present disclosure is not limited to the disclosed embodiments. On the contrary, the present disclosure aims to cover various modifications and equivalent arrangements included within the spirit and scope of the appended claims. The scopes of the following claims are in line with the most extensive interpretation so as to cover each of such modifications as well as equivalent structures and functions.

The invention claimed is:

1. A voltage driving pixel circuit comprising: any two power lines and a load connected in each of the power lines, wherein one or more switching circuits are between the any two power lines, wherein the switching circuits are turned on in response to the any two power lines being both of high voltage so that the any two power lines are interconnected.

2. The voltage driving pixel circuit according to claim 1, wherein one or more switching circuits are between all any two power lines.

3. The voltage driving pixel circuit according to claim 2, wherein the any two power lines are adjacent.

4. The voltage driving pixel circuit according to claim 1, wherein the any two power lines are power lines in odd rows.

5. The voltage driving pixel circuit according to claim 4, wherein the any two power lines are adjacent.

6. The voltage driving pixel circuit according to claim 1, wherein the any two power lines are power lines in even rows.

7. The voltage driving pixel circuit according to claim 6, wherein the any two power lines are adjacent.

8. The voltage driving pixel circuit according to claim 1, wherein the any two power lines are adjacent.

9. The voltage driving pixel circuit according to claim 1, wherein the farther from the input side of the power line, the more the switching circuits are arranged.

10. The voltage driving pixel circuit according to claim 1, wherein each of the switching circuits comprises two thin film transistors.

11. The voltage driving pixel circuit according to claim 10, wherein the nth power line in the any two power lines is connected to drains of a first thin film transistor and a second thin film transistor, the n+1th power line in the any two power lines is connected to the gate of the first thin film transistor and the source of the second thin film transistor, the source of the first thin film transistor is connected to the gate of the second thin film transistor.

12. The voltage driving pixel circuit according to claim 10, wherein each of the switching circuit comprises more than three thin film transistors.

13. A display panel comprising: a voltage driving pixel circuit as claimed in claim 1.

14. The display panel according to claim 13, wherein one or more switching circuits are between all any two power lines.

15. The display panel according to claim 13, wherein the any two power lines are power lines in odd rows.

16. The display panel according to claim 13, wherein the any two power lines are power lines in even rows.

17. The display panel according to claim 13, wherein the any two power lines are adjacent.

18. A method for driving a voltage driving pixel circuit as claimed in claim 1, comprising the step of: turning each of the switching circuits on in response to the any two power lines being both of high voltage.

19. The method for driving a voltage driving pixel circuit according to claim 18, wherein the any two power lines are adjacent.

* * * * *